US005231457A

United States Patent [19]

Nakano et al.

[11] Patent Number: 5,231,457

[45] Date of Patent: Jul. 27, 1993

[54] METHOD AND APPARATUS FOR PREVENTING ATTRACTION OF A WORK SHEET TO A TONER IMAGE FORMING SURFACE

[75] Inventors: Masaru Nakano, Tsukuba; Junichi Matsuno, Toride, both of Japan

[73] Assignees: Hitachi, Ltd.; Hitachi Koki Co., Ltd., both of Tokyo, Japan

[21] Appl. No.: 785,807

[22] Filed: Oct. 31, 1991

[30] Foreign Application Priority Data

Nov. 5, 1990 [JP] Japan ..... 2-299619

[51] Int. Cl.[5] ..... G03G 15/14

[52] U.S. Cl. ..... 355/273; 355/271; 355/308

[58] Field of Search ..... 355/271, 273, 274, 276, 355/308, 317; 271/245, 246, 229, 202, 306, 307

[56] References Cited

U.S. PATENT DOCUMENTS

| | | | |
|---|---|---|---|
| 4,128,327 | 12/1978 | Sugiyama et al. | 355/317 X |
| 4,362,378 | 12/1982 | Erskine et al. | 355/274 |
| 4,391,510 | 7/1983 | Cherian | 355/317 X |
| 4,396,273 | 8/1983 | Matsuyama et al. | 355/274 |
| 4,708,456 | 11/1987 | Shibata et al. | 355/317 X |
| 4,809,033 | 2/1989 | Ikemoto et al. | 355/271 |
| 4,878,657 | 11/1989 | Ura et al. | 355/317 X |
| 4,882,606 | 11/1989 | Deguchi | 355/274 |
| 4,958,199 | 9/1990 | Yamashita et al. | 355/317 |

FOREIGN PATENT DOCUMENTS

| | | | |
|---|---|---|---|
| 0088474 | 6/1982 | Japan | 355/271 |
| 0035567 | 3/1983 | Japan | 355/274 |
| 0095668 | 4/1990 | Japan . | |

*Primary Examiner*—A. T. Grimley
*Assistant Examiner*—William J. Royer
*Attorney, Agent, or Firm*—Antonelli, Terry, Stout & Kraus

[57] ABSTRACT

A method for xerographic printing, comprises the steps of, holding a part of a work sheet at a position other than a leading end of the work sheet, before the leading end contacts with a toner image forming surface on which a toner image is formed by an electrostatic, charge of toner, holding both surfaces of the leading end of the work sheet and applying a frictional force to at least one of the surfaces of the leading end so that a tension is applied to the work sheet between the held part and the leading end, before the leading end contacts with the toner image forming surface, and making the work sheet contact with the toner image forming surface, and transferring the toner image from the toner image forming surface to the surface of the work sheet by generating an electric field for attracting the charged toner to the surface of the work sheet.

20 Claims, 4 Drawing Sheets

METHOD AND APPARATUS FOR PREVENTING ATTRACTION OF A WORK SHEET TO A TONER IMAGE FORMING SURFACE

BACKGROUND OF THE INVENTION AND RELATED ART STATEMENT

The present invention relates to a method and apparatus for xerographic printing and more particularly, to a method and apparatus for preventing a work sheet from being attracted by a toner image forming surface from which a toner image is transferred to a surface of the work sheet.

As disclosed in Japanese Patent Unexamined Publication No. 2-95668, a work sheet is plastically bent between a high-rigidity roller and a low-rigidity roller before the work sheet contacts a toner image forming surface, in a manner that a leading end of the work sheet proceeds away from the toner image forming surface. In the prior art xerographic printing apparatus, the prevention of the work sheet being attracted by the toner image forming surface after a toner image is transferred to the work sheet cannot be prevented.

OBJECT AND SUMMARY OF THE INVENTION

An object of the present invention is to provide a method and apparatus for preventing the work sheet from being attracted by the toner image forming surface after the toner image is transferred from the toner image forming surface to the surface of the work sheet.

According to the present invention, a method for xerographic printing, comprises the steps of:

holding a part of a work sheet at a position other than a leading end of the work sheet, before the leading end contacts with a toner image forming surface on which a toner image is formed by an electro static charge of toner, holding both surfaces of the leading end of the work sheet and applying a frictional force to at least one of the surfaces of the leading end so that a tension is applied to the work sheet between the held part and the leading end, before the leading end contacts with the toner image forming surface, and making the work sheet contact with the toner image forming surface, and transferring the toner image from the toner image forming surface to the surface of the work sheet by generating an electric field for attracting the charged toner to the surface of the work sheet.

According to the present invention, an apparatus for xerographic printing, comprises:

a toner image forming surface on which a toner image is formed by an electro static charge of toner, first holding means for holding a part of a work sheet at a position other than a leading end of the work sheet, before the leading end contacts with the toner image forming surface, second means for holding both surfaces of the leading end of the work sheet and applying a frictional force to at least one of the surfaces of the leading end so that a tension is applied to the work sheet between the held part and the leading end, before the leading end contacts with the toner image forming surface, and transferring means for making the work sheet contact with the toner image forming surface, and for transferring the toner image from the toner image forming surface to the surface of the work sheet by generating an electric field for attracting the charged toner to the surface of the work sheet.

In the present invention, since a part of the work sheet is held at the position other than the leading end of the work sheet, both of the surfaces of the leading end of the work sheet are held and the frictional force is applied to at least one of the surfaces of the leading end so that the tension is applied to the work sheet between the held part and the leading end, an undesirable curvature of the leading end is corrected to be changed to a desirable substantially straight shape, before the leading end contacts with the toner image forming surface When the leading end has the substantially straight shape, the leading end is not attracted by the toner image forming surface after the toner image is transferred from the toner image forming surface to the surface of the work sheet. Therefore, the work sheet is prevented from being attracted by the toner image forming surface.

DETAILED DESCRIPTION OF PREFERRED EMBODIMENTS

Figure 5:
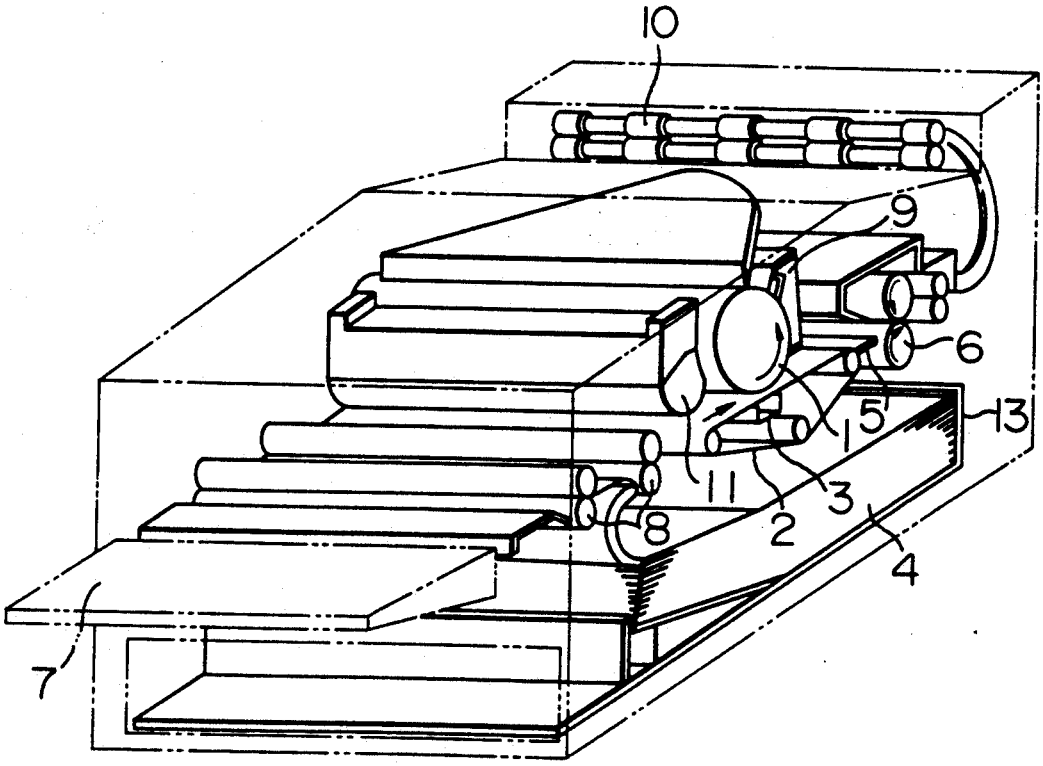
FIG. 5 is a schematic view of a copy machine including a xerographic printing apparatus according to the present invention.

In a copy machine as shown in FIG. 5, a work sheet 4 supplied from a hopper 13 is transferred by two pairs of register rollers 8 onto a feed belt 2 on which the work sheet is electrically charged to be held by the feed belt 2 through a coulombic force. Thereafter, the work sheet 4 is fed into a transferring portion between a toner image forming drum 1 on whose outer peripheral surface a toner image is formed by electro static charge of toner and an electrical field generating device 3. The work sheet 4 is electrically charged through the feed belt 2 by a corona charging of the electrical field generating device 3 so that the image of the charged toner on the toner image forming drum 1 is attracted onto the work sheet 4 by the coulombic force. After the toner image is transferred onto the work sheet 4, the work sheet 4, held by the feed belt 2 through the coulombic forced, is transferred to a pair of toner image fixing rollers 6 so that the toner image is fixed to the work sheet 4. Thereafter, the work sheet 4 is discharged from the copy machine by a pair of discharging rollers 10. A guide apparatus 5 is provided for guiding the work sheet, fed by the feed belt 2, to the fixing apparatus, with a cleaner 9 being provided for removing unnecessary toner from the toner image forming drum 1. A toner image forming apparatus 11 for forming the tone image on the toner image forming drum 1 and a tray 7 for enabling manual feeding of work sheets 4 are also provided in the copying machine.

Figure 6:
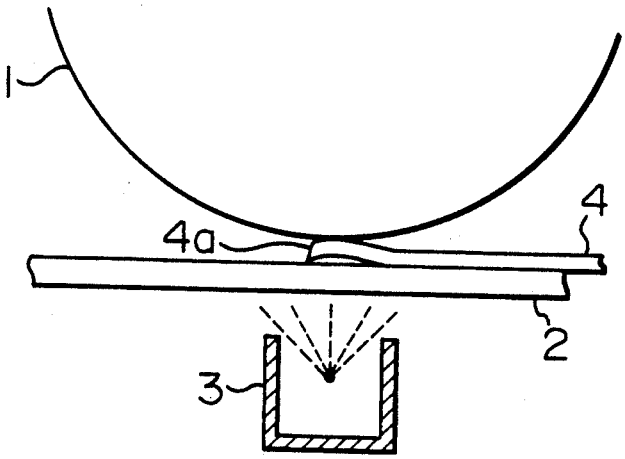
FIGS. 6 and 7 are schematic views of steps in which a work sheet is attracted by the toner image forming surface.
Figure 7:
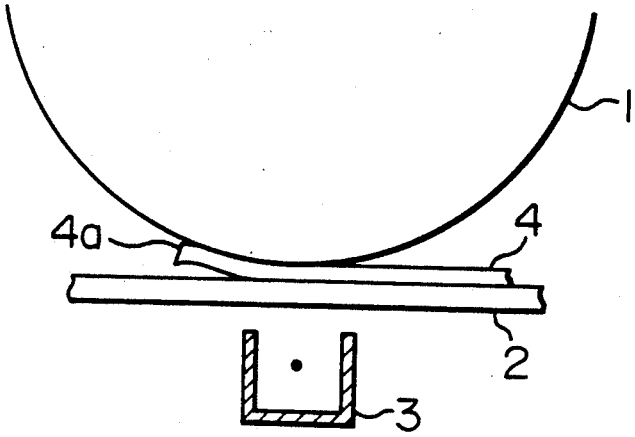
Figure 8:
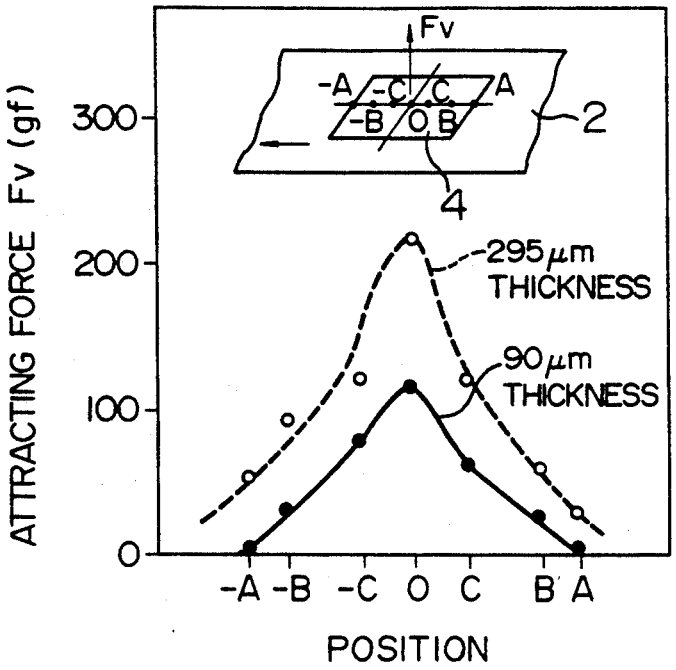
FIG. 8 is a graphical illustration of a relationship between positions of the work sheet and forces attracting the work sheet to the toner image forming surface in each of two kinds of the work sheets.

The corona charging of the electrical field generating device 3 applies a voltage opposite to a voltage of the charged toner on the toner image forming drum 1 to the feed belt 2 and the charged feed belt 2 electrically polarizes the work sheet 4 so that the work sheet 4 is attracted to the feed belt 2 by the coulombic force. As shown in FIG. 6, when a clearance 4*b* exists between the work sheet 4 and the feed belt 2 and the charged toner does not exist between the work sheet 4 and the toner image forming drum 1, there is a large possibility that a coulombic force between the work sheet 4 and the feed belt 2 is less than a coulombic force between the work sheet 4 and the toner image forming drum 1. When the work sheet 4 has an undesirable shaped end 4*a* to form the clearance 4*b* between the work sheet 4 and the feed belt 2 toner image forming drum 1 more strongly attracts the end 4*a* of the work sheet 4 in comparison with the feed belt 2. As shown in FIG. 7, after the end 4*a* of the work sheet 4 is attracted by the toner image forming drum 1 so as to be separated from the feed belt 2, the clearance increases continuously so that the coulombic force between the work sheet 4 and the feed belt 2 decreases continuously and a difference between the coulombic force between the work sheet 4 and the feed belt 2 and the coulombic force between the work sheet 4 and the toner image forming drum 1 increases continuously. As shown in FIG. 8, the coulombic force between the work sheet 4 and the feed belt 2 at the end of the work sheet 4 is significantly small in comparison with the coulombic force therebetween at an intermediate position thereof. Therefore, the end of the work sheet 4 can be easily removed from the feed belt 2.

Figure 10:
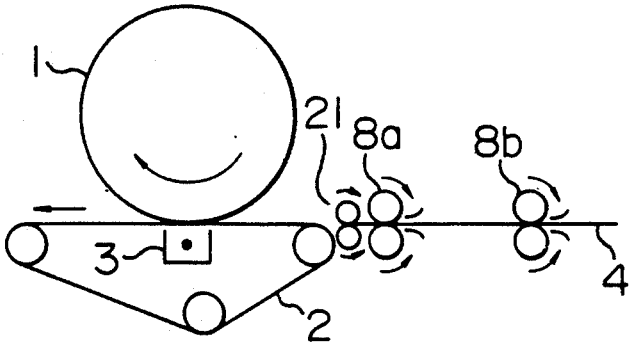
FIG. 10 is a schematic view of a further embodiment of a xerographic printing apparatus according to the present invention.

In order to prevent the attraction of the work sheet 4 to the toner image forming drum 1, it is necessary to correct the undesirable shape of the end 4*a* of the work sheet 4 to be changed to a substantially straight shape, preferably without stopping the feed of the work sheet 4. A device for correcting the undesirable shape of the end 4*a* may be arranged between the pair of register rollers which correct an attitude or direction of the end 4*a* and the transferring portion between the toner image forming drum 1 and the electrical field generating device 3. Alternatively a pair of register rollers 21 which correct an attitude or direction of the end 4*a* may be arranged between the device for correcting the undesirable shape of the end 4*a* and the transferring portion, as shown in FIG. 10. The direction of the end 4*a* is corrected by a wedge shaped clearance along a contact line formed between the register rollers 21 when a rotation of the pair of register rollers 21 is stopped, and then the register rollers 21 rotate to feed the work sheet 4 toward the transferring portion Before the work sheet 4 reaches the transferring portion, the undesirable shape of the leading end 4*a* of the work sheet 4 fed by the pair of feed rollers 8*b* is ,corrected by the pair of frictional movement rollers or members 8*a*. A force for pressing the work sheet 4 between the feed rollers 8*b* is generated by a spring 12, and a force for pressing the work sheet 4 between the frictional movement rollers 8*a* (preferably, force/work sheet width is 500 g/254 mm,) is generated by a weight of the frictional movement rollers 8*a* and/or a spring (not shown). The force for pressing the work sheet 4 between the feed rollers 8*b* is preferably larger than the force for pressing the work sheet 4 between the frictional movement rollers 8*a* and/or a frictional coefficient of an outer peripheral surface of the feed rollers 8*b* is preferably larger than that of the frictional movement rollers 8*a* so that the feed speed of the work sheet 4 is determined by the feed rollers 8*b*. A feed speed Vb of the work sheet 4 by the feed rollers 8*b* is less than a circumferential speed or frictional movement speed Va thereof by the frictional movement rollers 8*a* so that the frictional movement rollers 8*a* slide on the leading end 4*a* of the work sheet 4 held securely by the feed rollers 8*b* to apply a frictional force to the leading end 4*a* to generate a tension of the work sheet 4 between the pair of the frictional movement rollers 8*a* and the pair of the feed rollers 8*b* when the leading end 4*a* reaches the pair of the frictional movement rollers 8*a*. Since the leading end 4*a* is pressed between the frictional movement rollers 8*a* and the frictional force is applied to the leading end 4*a* to generate the tension of the work sheet 4, the undesirable shape of the end 4*a* can be corrected to be changed to the substantially straight shape without stopping the feed of the work sheet 4.

When the circumferential speed or frictional movement speed Va of one of the frictional movement rollers 8*a* is larger than the feed speed Vb of the work sheet 4 by the feed rollers 8*b*, the undesirable shape of the end 4*a* can be corrected. In that case, the circumferential speed of another one of the frictional movement rollers 8*a* is make substantially equal to the feed speed Vb of the work sheet 4 by the feed rollers 8*b*.

A distance between the pair of frictional movement rollers 8*a* and the pair of feed rollers 8*b* is less than a length of the work sheet 4 so that the part of the work sheet 4 is held by the pair of feed rollers 8*b* when the undesirable shape of the end 4*a* is corrected by the pair of frictional movement rollers 8*a*.

Figure 4:
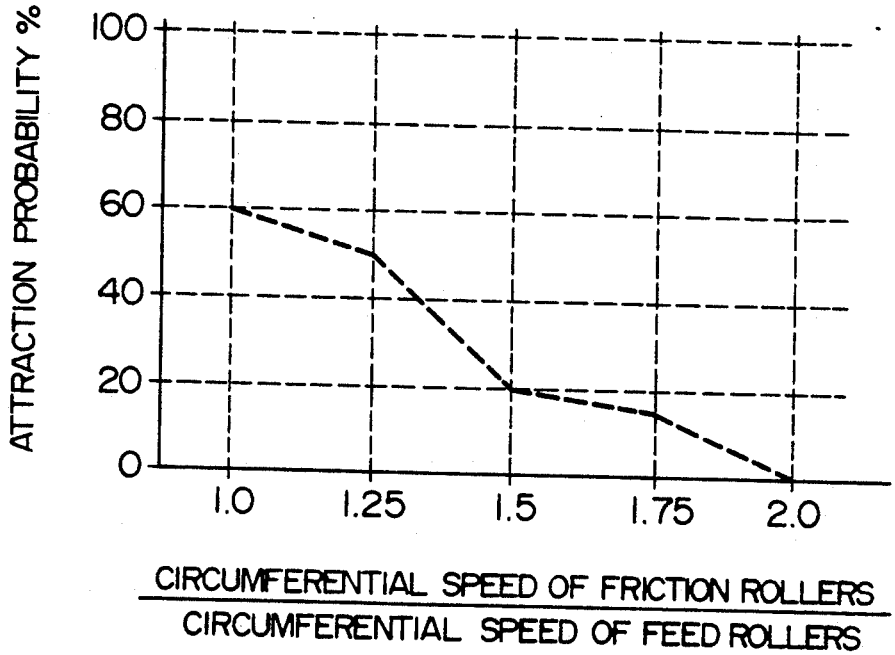
FIG. 4 is a graphical illustration of an experimental result of a relationship between a probability of an undesirable attraction of work sheet to a toner image forming surface and a ratio of a sheet urging speed of a pair of frictional movement rollers to a sheet feed speed by a pair of sheet feed rollers.

As shown in FIG. 4, when the sheet feed speed Vb by the pair of sheet feed rollers 8*b* is 254 mm/sec, a ratio of the frictional movement speed or sheet urging speed Va of the pair of frictional movement rollers 8*a* to the sheet feed speed Vb by the, pair of sheet feed rollers 8*b* is greater than 2, and, with the work sheet 4 having a thickness of 90 μm, the probability of undesirable attraction of the work sheet 4 to the toner image forming drum 1 is substantially zero.

Figure 1:
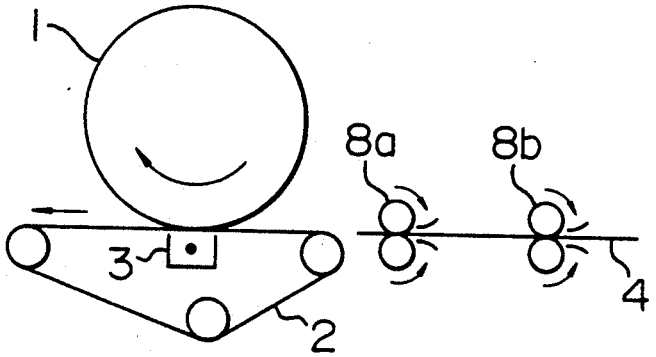
FIG. 1 is a schematic view of an embodiment of a xerographic printing apparatus according to the present invention.
Figure 2:
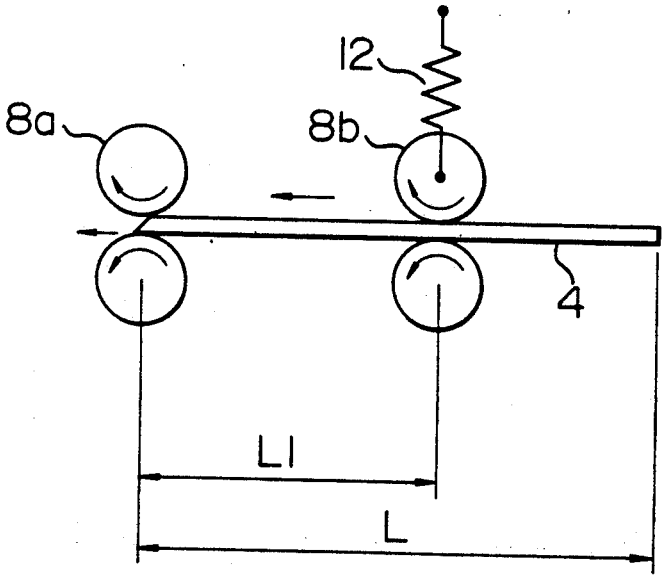
FIGS. 2 and 3 are schematic views of operations of the embodiment of FIG. 1.
Figure 3:
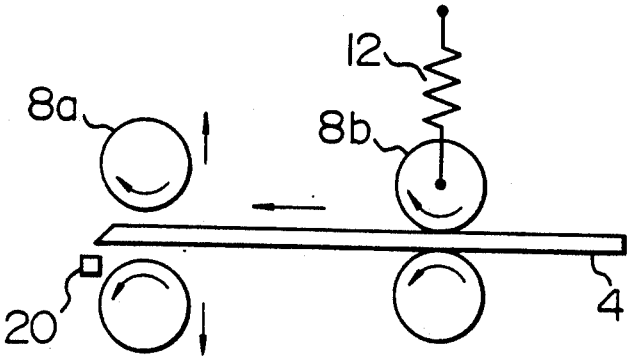

As shown in FIGS. 2 and 3, if the frictional movement rollers 8*a* are separated from each other not to apply the friction to the work sheet 4 after a leading end detector 20 detects the leading end 4*a* which has passed the pair of frictional movement rollers 8*a*, the friction is applied only to the leading end 4*a* and a frictional damage of a part other than the leading end 4*a* of the work sheet 4 is prevented. In order to achieve the same effect, the circumferential speed Va of the frictional movement rollers 8*a* may be made equal to the sheet feed speed Vb by the pair of sheet feed rollers 8*b* after the leading end detector 20 detects the leading end 4*a*.

The outer peripheral surfaces of the pair of frictional movement rollers 8*a* for applying the friction to the work sheet 4 is preferably made of a stainless steel.

Figure 9:
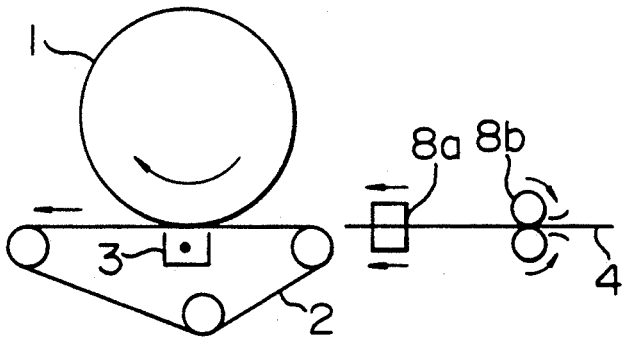
FIG. 9 is a schematic view of another embodiment of xerographic printing apparatus according to the present invention.

As shown in FIG. 9, the frictional movement rollers 8a may be replaced by frictional movement pads 8a including plane surfaces for applying the friction to the work sheet 4. The feed speed Vb of the work sheet 4 by the feed rollers 8b is smaller than the frictional movement speed Va thereof by the frictional movement pads 8a so that the frictional movement pads 8a slide on the leading end 4a of the work sheet 4 held securely by the feed rollers 8b to apply the frictional force to the leading end 4a to generate the tension of the work sheet 4 between the pair of the frictional movement pads 8a and the pair of the feed rollers 8b when the leading end 4a reaches the pair of the frictional movement pads or members 8a'. Since the leading end 4a is pressed between the frictional movement pads 8a' and the frictional force is applied to the leading end 4a to generate the tension of the work sheet 4, the undesirable shape of the end 4a can be corrected to be changed to the substantially straight shape without stopping the feed of the work sheet 4. When the movement speed Va of one of the frictional movement pads 8a' is greater than the feed speed Vb of the work sheet 4 by the feed rollers 8b, the undesirable shape of the end 4a can be also corrected. In that case, the speed of another one of the frictional movement pads 8a' is made substantially equal to the feed speed Vb of the work sheet 4 by the feed rollers 8b.

We claim:

1. Method for xerographic printing, the method comprising the steps of:

holding a part of a work sheet at a position other than a leading end of the work sheet, before the leading and contacts a toner image forming surface on which a toner image is formed by an electrostatic charge of toner, holding both surfaces of the leading end of the work sheet and applying a frictional force to at least one of the surfaces of the leading end by a frictional surface moving toward the toner image forming surface with a speed greater than a speed of the held part of the work sheet other than the leading end so that a tension is applied to the work sheet between the held part and the leading end, before the leading end contacts the toner image forming surface, and making the work sheet contact the toner image forming surface and transferring the toner image from the toner image forming surface to the surface of the work sheet by generating an electric field for attracting the charged toner to the surface of the work sheet.

2. A method according to claim 1, wherein the frictional force is applied to at least one of the surfaces of the leading end through a curved surface.

3. A method according to claim 1, wherein the frictional force is applied to both of the surfaces of the leading end.

4. A method according to claim 1, wherein the leading end is moving toward the toner image forming surface when the frictional force is applied to at least one of the surfaces of the leading end.

5. A method according to claim 1, wherein the step applying of the frictional force to at least one of the surfaces of the leading end is stopped after the frictional force is applied to a predetermined length of at least one of the surfaces of the leading end.

6. An apparatus for xerographic printing, the apparatus comprising:

a toner image forming surface on which a toner image is formed by an electrostatic charge of toner.

first holding means for holding a part of a work sheet at a position other than a leading end of the work sheet, before the leading end contacts the toner image forming surface, second means for holding both surfaces of the leading end of the work sheet comprising a frictional surface moving toward the toner image forming surface with a speed greater than a speed of a held part of the work sheet other than the leading end to apply a frictional force to at least one of the surfaces of the leading end so that a tension is applied to the work sheet between the held part and the leading end, before the leading end contacts the toner image forming surface, and transferring means for causing the work sheet to contact with the toner image forming surface and for transferring the toner image from the toner image forming surface to the surface of the work sheet by generating an electric field for attracting the charged toner to the surface of the work sheet.

7. An apparatus according to claim 6, wherein the second means include a curved surface for applying the frictional force to at least one of the surfaces of the leading end.

8. An apparatus according to claim 6, wherein the second means apply the frictional force to both of the surfaces of the leading end.

9. An apparatus according to claim 6, wherein the the second means apply the frictional force to at least one of the surfaces of the leading end when the first holding means is moving the work sheet toward the toner image forming surface.

10. An apparatus according to claim 6, wherein the second means include a pair of frictional movement rollers between which the leading end of the work sheet is held and the frictional force is applied to at least one of the surfaces of the leading end.

11. An apparatus according to claim 6, wherein the first means include a pair of feed rollers between which the part of the work sheet is held at the position other than the leading end of the work sheet.

12. An apparatus according to claim 6, wherein the second means stop applying of the frictional force to at least one of the surfaces of the leading end after the frictional force is applied to a predetermined length of at least one of the surfaces of the leading end.

13. An apparatus according to claim 6, wherein the apparatus further comprises register means for correcting a direction of the leading end of the work sheet between the second means and the transferring means so that the direction of the leading end is corrected after the leading end passes the second means.

14. A method for xerographic printing, the method comprising the steps of:

holding a part of a work sheet at a position other than a leading end of the work sheet, before the leading end contacts a toner image forming surface on which a toner image is formed by an electrostatic charge of toner, holding both surfaces of the leading end of the work sheet and applying a frictional force to at least one of the surfaces of the leading end so that a tension is applied to the work sheet between the held part and the leading end, before the leading end contacts the toner image forming surface, making the work sheet contact the toner image forming surface and transferring the toner image from the toner image forming surface to the surface of the work sheet by generating an electric field for attracting the charged toner to the surface of the work sheet, and wherein the frictional force is applied to at least one of the surfaces of the leading end through a planar surface.

15. An apparatus for xerographic printing, the apparatus comprising:

a toner image forming surface on which a toner image is formed by an electrostatic charge of toner;

first holding means for holding a part of a work sheet at a position other than a leading end of the work sheet, before the leading end contacts the toner image forming surface;

second means for holding both surfaces of the leading end of the work sheet and applying a frictional force to at least one at least one of the surfaces of the leading end so that a tension is applied to the work sheet between the held part and the leading end, before the leading end contacts the toner image forming surface, said second means includes a planar surface for applying the frictional force to at least one of the surfaces of the leading end, and transferring means for causing the work sheet to contact with the toner image forming surface, and for transferring the toner image from the toner image forming surface to the surface of the work sheet by generating an electric field for attracting the charged toner to the surface of the work sheet.

16. An apparatus for xerographic printing, the apparatus comprising:

a toner image forming surface on which a toner image is formed by an electrostatic charge of toner;

first holding means for holding a part of a work sheet at a position other than a leading end of the work sheet, before the leading end contacts the toner image forming surface;

second means for holding both surfaces of the leading end of the work sheet and applying a frictional force to at least one at least one of the surfaces of the leading end so that a tension is applied to the work sheet between the held part and the leading end, before the leading end contacts the toner image forming surface, said second means include a pair of frictional movement pads between which the leading end of the work sheet is held and the frictional force is applied to at least one of the surfaces of the leading end, and transferring means for causing the work sheet to contact with the toner image forming surface, and for transferring the toner image from the toner image forming surface to the surface of the work sheet by generating an electric field for attracting the charged toner to the surface of the work sheet.

17. An apparatus for xerographic printing, the apparatus comprising:

a toner image forming surface on which a toner image is formed by an electrostatic charge of toner;

first holding means for holding a part of a work sheet at a position other than a leading end of the work sheet, before the leading end contacts the toner image forming surface;

second means for holding both surfaces of the leading end of the work sheet and applying a frictional force to at least one at least one of the surfaces of the leading end so that a tension is applied to the work sheet between the held part and the leading end, before the leading end contacts the toner image forming surface, said second means apply the frictional force to at least one of the surfaces of the lading end when the first holding means is moving the work sheet toward the toner image forming surface and include a pair of frictional movement rollers between which the leading end of the work sheet is held, a speed of an outer peripheral surface of at least one of the frictional movement rollers is greater than a speed for moving the work sheet toward the toner image forming surface by the first holding means so that the frictional force is applied to at least one of the surfaces of the leading end, and transferring means for causing the work sheet to contact with the toner image forming surface, and for transferring the toner image from the toner image forming surface to the surface of the work sheet by generating an electric field for attracting the charged toner to the surface of the work sheet.

18. An apparatus for xerographic printing, the apparatus comprising:

a toner image forming surface on which a toner image is formed by an electrostatic charge of toner;

first holding means for holding a part of a work sheet at a position other than a leading end of the work sheet, before the leading end contacts the toner image forming surface;

second means for holding both surfaces of the leading end of the work sheet and applying a frictional force to at least one at least one of the surfaces of the leading end so that a tension is applied to the work sheet between the held part and the leading end, before the leading end contacts the toner image forming surface, said second means apply the frictional force to at least one of the surfaces of the leading end when the first holding means is moving the work sheet toward the toner image forming surface and include a pair of frictional movement pads between which the leading end of the work sheet is held, a moving speed of at least one of the frictional movement pads is greater than a speed for moving the work sheet toward the image forming surface by the first holding means so that the frictional force is applied to at least one of the surfaces of the leading end, and transferring means for causing the work sheet to contact with the toner image forming surface, and for transferring the toner image from the toner image forming surface to the surface of the work sheet by generating an electric field for attracting the charged toner to the surface of the work sheet.

19. An apparatus for xerographic printing, the apparatus comprising:

a toner image forming surface on which a toner image is formed by an electrostatic charge of toner, first holding means for holding a part of a work sheet at a position other than a leading end of the work sheet, before the leading end contacts the toner image forming surface, second means for holding both surfaces of the leading end of the work sheet and applying a frictional force to at least one of the surfaces of the leading end sot hat a tension is applied to the work sheet between the held part and the leading end, before the leading end contacts the toner image forming surface, and transferring means for making the work sheet contact with the toner image forming surface, and for transferring the toner image from the toner image forming surface to the surface of the work sheet by generating an electric field for attracting the charged toner to the surface of the work sheet, wherein the second means stop applying the frictional force to at least one of the surfaces of the leading end after the frictional force is applied to a predetermined length of at least one of the surfaces of the leading end, and wherein the second means have a pair of frictional movement members between which the leading end of the work sheet is held for applying the frictional force to at least one of the surfaces of the leading end, the frictional movement members are separated from each other when the applying of the frictional force to at least one of the surfaces of the leading end is stopped.

20. An apparatus for xerographic printing, the apparatus comprising:

a toner image forming surface on which a toner image is formed by an electrostatic charge of toner, first holding means for holding a part of a work sheet at a position other than a leading end of the work sheet, before the leading end contacts the toner image forming surface, second means for holding both surfaces of the leading end of the work sheet and applying a frictional force to at least one of the surfaces of the leading end so that a tension is applied to the work sheet between the held part and the leading end, before the leading end contacts the toner image forming surface, and transferring means for making the work sheet contact with the toner image forming surface, and for transferring the toner image from the toner image forming surface to the surface of the work sheet by generating an electric field for attracting the charged toner to the surface of the work sheet, wherein the second means stop applying the frictional force to at least one of the surfaces of the leading end after the frictional force is applied to a predetermined length of at least one of the surfaces of the leading end, and wherein the second means move at a speed substantially equal to a speed for moving the work sheet toward the toner image forming surface by the first means when the applying of the frictional force to at least one of the surfaces of the leading end is stopped.

* * * * *